US012104302B2

(12) United States Patent
Chen

(10) Patent No.: US 12,104,302 B2
(45) Date of Patent: Oct. 1, 2024

(54) FATIGUE-RESISTANT LAYERED ELASTOMERIC STRUCTURE

(71) Applicant: Wuxi Keyi New Material CO., LTD., Wuxi (CN)

(72) Inventor: Hao Chen, Wuxi (CN)

(73) Assignee: WuXi KeYi New Material CO., LTD, WuXi (CN)

( * ) Notice: Subject to any disclaimer, the term of this patent is extended or adjusted under 35 U.S.C. 154(b) by 0 days.

(21) Appl. No.: 18/016,348

(22) PCT Filed: Jun. 30, 2021

(86) PCT No.: PCT/CN2021/103695

§ 371 (c)(1),
(2) Date: Jan. 15, 2023

(87) PCT Pub. No.: WO2022/012335

PCT Pub. Date: Jan. 20, 2022

(65) Prior Publication Data

US 2023/0279592 A1 Sep. 7, 2023

(30) Foreign Application Priority Data

Jul. 17, 2020 (CN) ..... 202010520528.7

(51) Int. Cl.
*D04H 3/011* (2012.01)
*B32B 5/26* (2006.01)
(Continued)

(52) U.S. Cl.
CPC ..... *D04H 3/011* (2013.01); *D04H 3/16* (2013.01); *A47C 27/12* (2013.01); *D10B 2503/00* (2013.01)

(58) Field of Classification Search
CPC ..... D04H 3/011; D04H 3/009; A47C 27/12; B32B 5/26; B32B 5/266; B32B 5/273
See application file for complete search history.

(56) References Cited

U.S. PATENT DOCUMENTS

2016/0010250 A1* 1/2016 Taninaka ..... D04H 3/16 428/221
2018/0086623 A1* 3/2018 Takaoka ..... D04H 3/16

FOREIGN PATENT DOCUMENTS

CN 105026632 A 11/2015

OTHER PUBLICATIONS

"Study on the preparation and properties of thermoplastic polyether ester elastomers", Cheng Zhang, < China Master's Theses Full-text Database, Engineering and Technology I >, May 15, 2019.

* cited by examiner

*Primary Examiner* — Joanna Pleszczynska
(74) *Attorney, Agent, or Firm* — iPA & iPM

(57) ABSTRACT

A fatigue-resistant layered elastomeric structure is obtained by first extruding raw material of thermoplastic polyester elastomer into long linear structures. The long linear structures are further curled and bonded to form a volume of layered elastomeric structure with a certain thickness. Intermittently bonded points and continuously bonded points with fused sections equal to longer than 5 mm are formed during this process. Among all bonded points, the continuously bonded points have a proportion of at least 20%. Hardness loss rate after repeated compression is less than 23%. Relevant parameters are adjusted to obtain even larger percentages of continuously bonded points with better repeated compression durability.

5 Claims, 2 Drawing Sheets

(51) Int. Cl.
*D04H 3/16* (2006.01)
*A47C 27/12* (2006.01)

| Used materials | Contents of polytetramethylene ether glycol | Hardness Shore A | Melting point | Melt index g/10 min |
|---|---|---|---|---|
| Polyester elastomer A1 | 55 | 90 | 169 | 15 |
| Polyester elastomer A2 | | | | 35 |
| Polyester elastomer B1 | 70 | 84 | 171 | 20 |
| Polyester elastomer B2 | | | | 8 |
| Polyester elastomer C1 | 52 | 95 | 207 | 15 |
| Polyester elastomer C2 | 65 | 87 | 180 | 25 |

| Material | Embodiment 1 | Embodiment 2 | Embodiment 3 | Comparison example 1 | Comparison example 2 | Comparison example 3 |
|---|---|---|---|---|---|---|
| Polyester elastomer A1/% | 100 | | | | | |
| Polyester elastomer A2/% | | | | 100 | | |
| Polyester elastomer B1/% | | 100 | | | | |
| Polyester elastomer B2/% | | | | | 100 | |
| Polyester elastomer C1/% | | | | | | 100 |
| Polyester elastomer D1/% | | | 100 | | | |
| Cooling water temperature/ | 30 | | | | | |
| Thickness/mm | 50.6 | 50.6 | 49.9 | 49.7 | 50.4 | 50.2 |
| Density/Kg/m$^3$ | 60 | 61 | 61 | 59 | 60 | 60 |
| Wire diameter/mm | 0.83 | 0.75 | 0.77 | 0.81 | 0.93 | 0.91 |
| 40% compression hardness/N | 189 | 133 | 157 | 171 | 123 | 244 |
| Hardness loss rate after fatigue-resistant cyclic compression /% | 22 | 15 | 19 | 31 | 26 | 33 |
| Proportion of continuously bonded point /% | 26 | 31 | 24 | 17 | 13 | 14 |

Fig. 3

FATIGUE-RESISTANT LAYERED ELASTOMERIC STRUCTURE

TECHNICAL FIELD

Present disclosure relates to a layered elastomer of a certain thickness formed by curled filaments. Raw materials of filaments are thermoplastic polyester elastomers, which can be manufactured to comprise fatigue-resistant layers, suitable for office chairs, sofas, beds etc.

BACKGROUND TECHNOLOGY

Existing layered elastomers are generally made by means of spinning, to be specific, the polyester elastomer at molten state is extruded through spinning die at a certain speed and temperature, and after being extruded, the elastomer is put into water for cooling, the continuous linear structure is bent into a ring, the contact parts are welded together to make both sides flat, and finally the polyester elastomer is cut into the required size to get the three-dimensional network structure. As existing layered elastomers are commonly applied in cushions, mattresses etc., it needs to consider their repeated compression durability, i.e., the fatigue durability.

Chinese patent CN109680412A discloses a network structure which has a residual strain of less than 15% under the effect of 50% constant displacement repeated compression and has a hardness retention rate of more than 85% under the effect of 50% compression after 50% constant displacement repeated compression. According to the paragraph 0048 of this patent, in order to obtain the network structure, the continuous linear structures of the network structure must be firmly fused to enhance the strength of contacts between the continuous linear structures. By enhancing the strength of contacts between the continuous linear structures that constitute the network structure, it can improve the repeated compression durability of the network structure. As described in paragraphs 0049 and 0051 of the patent, the methods for obtaining a network structure with enhanced contact strength are as follows: After the polyester thermoplastic elastomer is spun out, it can set a thermal insulation area below the nozzle, increase the net surface temperature in the surrounding area of the falling position of the continuous linear structure of the traction conveyor net, or increase the cooling water temperature in the cooling tank in the surrounding area of the falling position of the continuous linear structure. This patent aims to improve the product manufacturing process to obtain the network structure with high contact strength, thus making compression parameters of the product consistent with the expected value.

Chinese patent CN105683434B discloses a network structure with excellent compression durability performance, and such network structure has a residual strain of less than 15% under the effect of 750 N constant load repeated compression, a hardness retention rate of more than 55% under the effect of 40% compression after 750 N constant load repeated compression, and a hardness retention rate of more than 70% under the effect of 65% compression after 750 N constant load repeated compression. As described in paragraphs 0056 and 0057 of the patent, to realize the excellent compression durability, the structural difference is given between the surface layer and the inner layer (by setting the fiber diameter of the surface layer as 1.05 times or more the fiber diameter of the inner layer) and the strength of contacts between continuous linear structures of the surface layer is enhanced; by giving the structural difference between the surface layer and the inner layer and increasing the contact area of the continuous linear structure compared with the inner layer, it can enhance the strength of contacts at surface layer of the network structure, further suppress the contact destruction generated during the repeated compression treatment, and constantly achieve the surface dispersion effect of load (750 N) borne during the repeated compression at surface layer. The product can have excellent compressive durability by setting the compressive strength on its surface layer.

The above patent does not specify the relationship between randomly bonded points and durability of layered elastomers. The hardness loss rate of layered elastomer product obtained in patent CN105683434B after 750 N repeated compression can only be maintained between 30%-45%, and the durability of layered elastomer products obtained using the methods described in patents CN109680412A and CN105683434B cannot be further improved.

Contents of the Invention

Considering the above disadvantage that it fails to obtain layered elastomers with more excellent durability through existing production, the applicant provides a fatigue-resistant layered elastomer to control the proportion of continuously bonded points and further improve the compression durability and service life of the layered elastomer.

The technical scheme adopted by the invention and its beneficial effects are as follows: It relates to a fatigue-resistant layered elastomer which is extruded into the long linear structure by using thermoplastic polyester elastomer as raw materials, then is curled and bonded to form a layered body of a certain thickness. The contact parts of adjacent linear structures are fused together to form continuously bonded points or intermittently bonded points, among which, the proportion of continuously bonded points is over 20%. When the proportion of continuously bonded points is greater than 20%, the hardness loss rate after fatigue-resistant repeated compression is less than 23%. The larger the proportion of continuously bonded points, the better the repeated compression durability. Therefore, by increasing the proportion of continuously bonded points of layered elastomers, it enables us to obtain products with repeated compression durability.

The above technical scheme is further improved as follows: The melt index of the raw material of the above-mentioned thermoplastic polyester elastomer is 15-25 g/10 min. The invention finds that the melt index of the raw material of thermoplastic polyester elastomer is significantly related to the proportion of the continuously bonded points of the layered elastomer. When the melt index of the raw material of thermoplastic polyester elastomer is 15-25 g/10 min, the product with high proportion of continuously bonded points and low fatigue-resistant repeated compression hardness loss rate can be obtained. In case the melt index is greater than 25 g/10 min, the proportion of continuously bonded points decreases and the compression durability of the product becomes worse. It is probably because that the larger the melt index, the better the processing flowability of the materials, the quicker the speed of the continuous linear structure outflowing from the spinning die; When the traction rate is controlled as constant, the wire diameter of the continuous linear structure will be thinner, and when the wire diameter is thinner, there will be a lower probability of forming continuously bonded points at the fusing position, and therefore, the proportion of continuously bonded points of the final product will be decreased.

In case the melt index is less than 15 g/10 min, the proportion of continuously bonded points decreases, and the compression durability of the product becomes worse. It is probably because that the smaller the melt index, the worse the processing flowability of the materials, the slower the speed of the continuous linear structure outflowing from the spinning die; When the traction rate is controlled as constant, the wire diameter of the continuous linear structure will be thicker, and although the wire diameter is thicker, it is because of relatively low flow speed of the continuous linear structure, thus causing decrease in temperature earlier in the falling process; therefore, fusing parts formed after being put into water become less as well as there is a lower probability of forming continuously bonded points at the fusing position, and finally, the proportion of continuously bonded points of the final product will be decreased.

The melting point of the above-mentioned raw material of thermoplastic polyester elastomer is below 180° C.; The invention finds that the melting point of the raw material of thermoplastic polyester elastomer is significantly related to the proportion of the continuously bonded point of the layered elastomer. When the melt index, i.e., melting point, of the raw material of thermoplastic polyester elastomer is less than 180° C., the product with high proportion of continuously bonded point and low fatigue-resistant repeated compression hardness loss rate can be obtained. In case the melting point of polyester elastomer is greater than 180° C., the proportion of continuously bonded points decreases and the compression durability of the product becomes worse. It is probably because that the melting point is higher. After it is extruded out at 225° C. at the molten state, the continuous linear structures are not easy to be bonded together, fusing parts of products formed become less and there is a lower probability of forming continuously bonded points at the fusing position. Although the products with certain hardness can be obtained at high melting point, the proportion of continuously bonded points is not high, eventually leading to poor repeated compression durability.

The continuously bonded point mentioned is a fusing part of more than or equal to 5 mm long.

After the layered elastomer mentioned is repeatedly compressed for 80,000 times under the compression force of 750 N, the hardness loss rate will be less than 25%. Although the existing products' fatigue durability can be improved by enhancing the strength of the contact or setting a structural difference between the surface layer and the inner layer, the hardness loss rate of products formed using current method after 750 N repeated compression can only be maintained between 30%-45%, and it fails to obtain a lower hardness loss rate after repeated compression. By controlling the proportion of continuously bonded points to be greater than 20% in this patent, the layered elastomer with excellent repeated compression durability and with the hardness loss rate <25% can be obtained, and such elastomer is applicable to the products with fatigue durability requirements, for example, the cushions and mattresses.

The 40% compression hardness of the layered elastomer mentioned is 100 N-350 N.

The thickness of the layered elastomer mentioned is 20 mm-200 mm and the density is 30 kg/m$^3$-100 kg/m$^3$.

The continuous filaments of the layered elastomer mentioned are round solid filaments, special-shaped filaments or hollow filaments.

The soft block of the raw material of thermoplastic polyester elastomer mentioned is polytetramethylene ether glycol.

The content of polytetramethylene ether glycol soft block contained in the raw material of the thermoplastic polyester elastomer mentioned is 70%, melting point of the raw material is 171° C., and the melt index is 20 g/10 min. When the content of polytetramethylene ether glycol soft block contained in the raw material of the thermoplastic polyester elastomer mentioned is 70%, melting point of the raw material is 171° C. and the melt index is 20 g/10 min, the proportion of continuously bonded points is 31%, the hardness loss rate after fatigue-resistant repeated compression is only 15%, and the fatigue durability of layered elastomer is the optimal.

DESCRIPTION OF FIGURES

FIG. 1 is a structural diagram of layered elastomer products, with 1. Continuously bonded point; 2. Intermittently bonded point, and 3. Layered elastomer.

FIGS. 2 and 3 illustrates Table 1 and 2 respectively.

DETAILED DESCRIPTION OF EMBODIMENTS

Figures 1, 2:
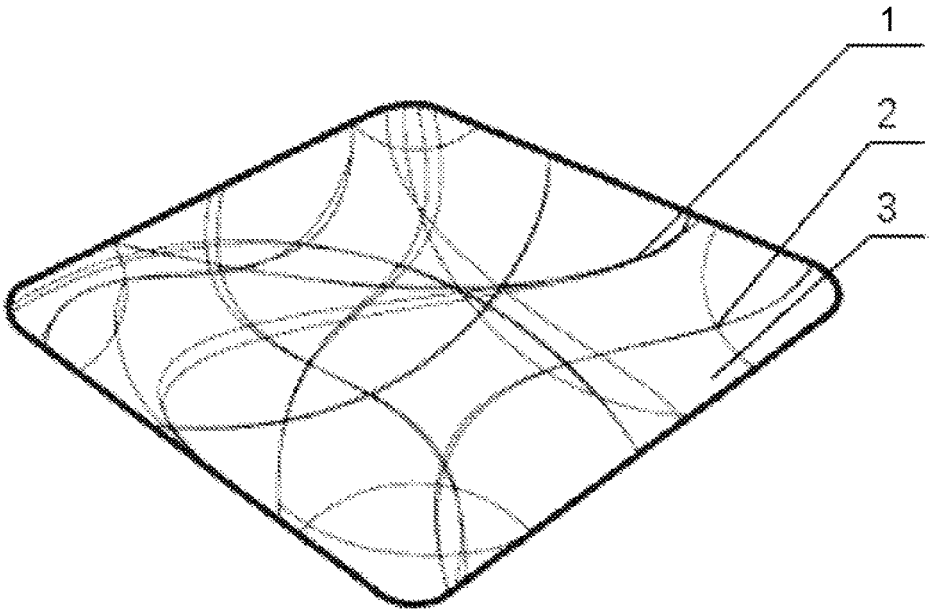

Specific embodiments of the invention will be described combined with the following figures.

As the polyester thermoplastic elastomer, dimethyl terephthalate (DMT), 1,4-butanediol (1, 4-BD), polytetramethylene glycol (PTMG), tetrabutyl titanate (TBT) catalyst and stabilizer Irganox 1010 shall undergo the esterification reaction at 230° C., and after the removal amount of by-product methanol reaches more than 98% of the theoretical value, it shall heat up to 245° C. and reduce pressure to 100 Pa in vacuum for polycondensation, and after being polymerized to a desired viscosity, it shall form grains and finally generate the polyether-ester block copolymer elastomers. The formula of the obtained thermoplastic elastomer material is recorded in Table 1, wherein, the melt index is controlled by means of controlling manufacturing condition parameters such as polymerization time.

Table 1 is illustrated in FIG. 2

The specific test method is as follows:

1. Thickness: Randomly take 3 samples, measure the thickness of products using the thickness gauge, and calculate the average value.

2. Density: Put the product in the drying oven, and set the oven at 80° C.*3 hr. After removal of moisture, measure the length, width and height of the product and calculate the volume of the product, and use precision balance to get the weight which is corrected to three decimal places, then divide the weight by the volume to calculate the density.

3. Wire diameter: Randomly take 5 fibers from the three-dimensional network structure, and use 20-fold optical microscope and scale to measure the diameters of 3 positions, calculate the average diameter of each fiber, then calculate the average value of 5 fibers;

4. 40% compression hardness test: At the constant temperature of 23° C., put the product between the upper and lower compression plates, and compress the product to reach the strain 40% at a test speed of 100 mm/min. By using the upper compression plate to compress the product downwards, the load cell at the upper end will sense the pressure, convert the pressure into the voltage signal and send the voltage signal to the display for analysis. Meanwhile, display pressure value on the screen, and take average value of three tests.

5. Hardness loss rate after fatigue-resistant repeated compression: At the constant temperature of 23° C., put the product on the lower platform of the repeated compression tester, compress the product repeatedly at the compression force of 750 N and a frequency of 70 time/minute, then evaluate the performance of the product after 80,000 times of compression. Hardness loss rate after fatigue-resistant repeated compression= (40% compression hardness before product test-40% compression hardness after product test)/40% compression hardness before product test*100%, measure 3 samples and take average value.

6. Bonded point: Take the 5 cm*5 cm sample and use precision balance to get the weight which is corrected to the first decimal place, as shown in FIG. 1, define the intersection point with a length <5 mm at the fusing part between the linear structures of the layered elastomer 3 as the intermittently bonded point 2 and define the intersection point with a length≥5 mm at the fusing part between the linear structures as the continuously bonded point 1; The counter shall carefully strip the intersection parts between linear structures, carefully observe and calculate the quantity of intermittently bonded point 2 and continuously bonded point 1, and after the quantity of obtained bonded points is divided by the sample weight, it can obtain the quantity of intermittently bonded points and continuously bonded points per unit volume (unit: pcs./g). Proportion of continuously bonded points=quantity of continuously bonded points/(quantity of continuously bonded points+quantity of intermittently bonded points).

Embodiment 1

By sending the raw materials of polyester elastomer A1 into the extruder, the materials shall be heated up to a molten state of 225° C. in the extruder and conveyed to the spinning die through the metering pump, the continuous linear structure fibers are sprayed from the spinning die into the water and are bent into a ring. The contact parts between the linear structures are fused together, the traction rate is 0.4 m/min, infrared insulation method is adopted between the spinning die and the lower water tank, the well-woven continuous linear structure fibers are compressed by a mold in 30° C. warm water to make both sides flat, and finally, the three-dimensional layered elastomer 3 is formed. The above method is used to test the layered elastomer, thus obtaining the physical parameters as shown in Table 2. The network structure density of the layered elastomer 3 is 60 kg/m$^3$, and the proportion of continuously bonded points of the layered elastomer 3 obtained is 26%, the 40% compression hardness is 189 N, and the hardness loss rate after fatigue-resistant repeated compression is 22%.

Embodiment 2

The specific implementation method is same as that of embodiment 1, however, the raw material adopted is changed to polyester elastomer B1, and the proportion of continuously bonded points of layered elastomer 3 obtained is 31%, the 40% compression hardness is 133 N, and the hardness loss rate after fatigue-resistant repeated compression is 15%.

Comparison Example 1

The specific implementation method is same as that of embodiment 1, however, the raw material adopted is changed to polyester elastomer A2, and the proportion of continuously bonded points of three-dimensional network structure is 17%, the 40% compression hardness is 171 N, and the hardness loss rate after fatigue-resistant repeated compression is 31%.

Comparison Example 2

The specific implementation method is same as that of embodiment 1, however, the raw material adopted is changed to polyester elastomer B2, and the proportion of continuously bonded points of three-dimensional network structure is 13%, the 40% compression hardness is 123 N, and the hardness loss rate after fatigue-resistant repeated compression is 26%.

Comparison Example 3

The specific implementation method is same as that of embodiment 1, however, the raw material adopted is changed to polyester elastomer C1, and the proportion of continuously bonded points of three-dimensional network structure is 14%, the 40% compression hardness is 244 N, and the hardness loss rate after fatigue-resistant repeated compression is 33%.

Table 2 is illustrated in FIG. 3. By comparing Embodiment 1-3 and comparison examples 1-3, it can be seen that when the proportion of continuously bonded points is less than 20%, the hardness loss rate after fatigue-resistant repeated compression will exceed 25%, and the less the continuously bonded points 1, the worse the repeated compression durability. Therefore, by increasing the proportion of continuously bonded points of layered elastomer 3, it enables us to obtain products with repeated compression durability. When the proportion of continuously bonded points is 31%, the hardness loss rate after fatigue-resistant repeated compression is only 15%, and the fatigue durability of product is the optimal.

By comparing embodiment 1 and comparison example 1, when the melt index is 35 g/10 min, the proportion of continuously bonded points of the layered elastomer 3 is only 17%. At this time, although the 40% compression hardness can reach 171 N, the hardness loss rate after fatigue-resistant repeated compression can rise to 31%. It can be seen that when the melt index is greater than 25 g/10 min, the proportion of continuously bonded points decreases and the compression durability of the product becomes worse. It is probably because that the larger the melt index, the better the processing flowability of the materials, the quicker the speed of the continuous linear structure outflowing from the spinning die; When the traction rate is controlled as constant, the wire diameter of the continuous linear structure will be thinner, and when the wire diameter is thinner, there will be a lower probability of forming continuously bonded point 1 at the fusing position, and therefore, the proportion of continuously bonded points of the final product will be decreased.

By comparing embodiment 2 and comparison example 2, when the melt index is 8 g/10 min, the proportion of continuously bonded points of the layered elastomer 3 is only 13%. At this time, although the 40% compression hardness can reach 123 N, the hardness loss rate after fatigue-resistant repeated compression can rise to 26%. It can be seen that when the melt index is less than 15 g/10 min, the proportion of continuously bonded points decreases and the compression durability of the product becomes worse. It is probably because that the smaller the melt index, the worse the processing flowability of the materials, the slower the speed of the continuous linear structure outflowing from the spinning die; When the traction rate is controlled as constant, the wire diameter of the continuous linear structure will be thicker, and although the wire diameter is thicker, it is because of relatively low flow speed of the continuous linear structure, thus causing decrease in temperature earlier in the falling process; therefore, fusing parts formed after being put into water become less as well as there is a lower probability of forming continuously bonded point 1 at the fusing position, and finally, the proportion of continuously bonded points of the final product will be decreased.

By comparing embodiment 1 and comparison example 3, when the melting point of polyester elastomer is 207° C., although the melt index is same, the proportion of continuously bonded points of the layered elastomer 3 obtained in comparison example 3 is only 14%. At this time, although the 40% compression hardness can reach 244 N, the hardness loss rate after fatigue-resistant repeated compression can rise to 33%. It can be seen that when the melting point of polyester elastomer is greater than 180° C., the proportion of continuously bonded points decreases and the compression durability of the product becomes worse. It is probably because that the melting point is higher. After it is extruded out at 225° C. at the molten state, the continuous linear structures are not easy to be bonded together, fusing parts of products formed become less and there is a lower probability of forming continuously bonded point 1 at the fusing position. Although the products with certain hardness can be obtained at high melting point, the proportion of continuously bonded points is not high, eventually leading to poor repeated compression durability.

The above-mentioned description is an explanation of the invention but not the restriction over the invention, and the invention can be modified in any form without going against the spirit of the invention. For example, the filaments of the layered elastomer 3 are round solid filaments in the above-mentioned embodiments and the comparison examples, or the special-shaped filaments or hollow filaments in other modes of implementation.

The invention claimed is:

1. A fatigue-resistant layered elastomeric structure obtained by extruding raw material of thermoplastic polyester elastomer into long linear structures, curling, and bonding the long linear structures to form a layered three dimensional structure with a preset volume, wherein the raw material of thermoplastic polyester elastomer has a melt index of 15-25 g/10 min and a melting point below 180° C.;

the long linear structures in contact with each other form intermittently bonded points and a proportion of at least 20% of continuously bonded points among a total number of bonded points, wherein the continuously bonded points comprise fused sections being 5 mm in length or longer; and the layered elastomeric structure has a hardness loss rate less than 25% after being repeatedly compressed for 80,000 times under a compression force of 750 N, and a 40% compression hardness between 100 N and 350 N.

2. The fatigue-resistant layered elastomeric structure of claim 1, wherein the volume of the layered elastomeric structure has a thickness between 20 mm-200 mm, and a density of 30-100 kg/m$^3$.

3. The fatigue-resistant layered elastomeric structure of claim 1, wherein the long linear structures comprise round solid cross sections, irregular-shaped cross sections, and/or hollow cross sections.

4. The fatigue-resistant layered elastomeric structure of claim 1, wherein the raw material of thermoplastic polyester elastomer comprises polytetramethylene ether glycol soft block.

5. The fatigue-resistant layered elastomeric structure of claim 1, wherein the raw material of the thermoplastic polyester elastomer comprises 70% of polytetramethylene ether glycol soft block, the raw material has a melting point of 171° C., and a melt index of 20 g/10 min.

* * * * *